US006109325A

United States Patent [19]

Chang

[11] Patent Number: 6,109,325

[45] Date of Patent: Aug. 29, 2000

[54] PORTABLE ELECTRICAL BINDING APPARATUS

[76] Inventor: Jeff Chieh Huang Chang, No. 34-3, Lane 101, 38th Rd., Taichung Industrial Park, Taichung, Taiwan

[21] Appl. No.: 09/228,622

[22] Filed: Jan. 12, 1999

[51] Int. Cl.[7] ..... B65B 13/32

[52] U.S. Cl. ..... 156/494; 156/510; 156/579; 156/580; 100/32; 100/33 PB

[58] Field of Search ..... 156/73.5, 157, 156/159, 229, 494, 502, 510, 579, 580, 583.1; 100/29, 32, 33 PB

[56] References Cited

U.S. PATENT DOCUMENTS

| | | | |
|---|---|---|---|
| 4,050,372 | 9/1977 | Kobiella | 156/73.5 X |
| 4,313,779 | 2/1982 | Nix | 156/361 |
| 4,820,363 | 4/1989 | Fischer | 156/494 |
| 5,306,383 | 4/1994 | Kobiella | 156/468 |
| 5,380,393 | 1/1995 | Drabarek et al. | 156/358 |
| 5,476,569 | 12/1995 | Harada | 156/502 |
| 5,632,851 | 5/1997 | Young | 156/494 |
| 5,942,061 | 8/1999 | Figiel et al. | 156/73.5 |
| 5,954,899 | 9/1999 | Figiel et al. | 156/73.5 |
| 6,003,578 | 12/1999 | Chang | 156/494 |

*Primary Examiner*—James Sells
*Attorney, Agent, or Firm*—Rosenberg, Klein & Lee

[57] ABSTRACT

The present invention relates to a handheld electrical binding apparatus, primarily comprising an improved tensioning unit and a melting and cutting unit that cooperates with a control unit to provide maximum convenience in use. The apparatus of the invention can efficiently stretch binding straps and then melt and cut it, achieving the purpose of securing a package with bands.

8 Claims, 13 Drawing Sheets

PORTABLE ELECTRICAL BINDING APPARATUS

SUMMARY OF THE INVENTION

A small conventional electrical binding apparatus generally comprises a motor to drive a transmission mechanism and to govern a tensioning and a melting device to proceed the operations of stretching, and melting. With such an apparatus, a package can be held with thermoplastic straps for handling or transportation purposes. One of such apparatuses is disclosed in the U.S. patent application Ser. No. 09/071,882 U.S. Pat. No. 6,003,578 filed by the same applicant of this present invention. The invention improves the binding apparatus to enable the routing of binding straps and the adjustment of tension to be done in an easy way. Further, the binding apparatus can automatically conduct the stretching, wrapping, melting, and sealing operations. The apparatus according to the invention has better performance as well as the enhancement of wrapping efficiency in comparison with a conventional one.

Now the structure and features of the invention will be described in detail with reference to the accompanying drawings.

DETAILED DESCRIPTION OF PREFERRED EMBODIMENTS

Figure 1:
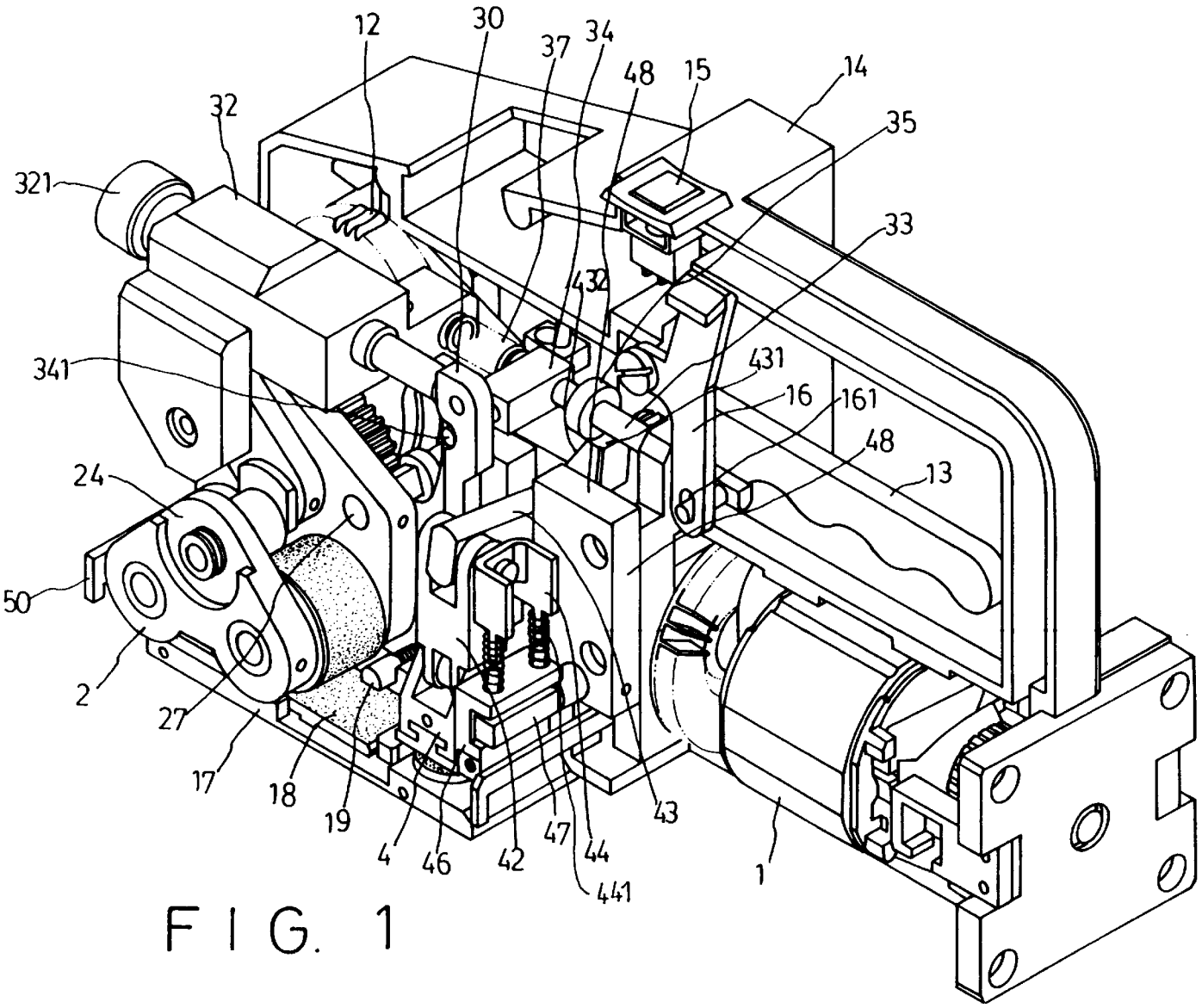
FIG. 1 is a perspective assembly view of a handheld binding apparatus according to the invention.
Figure 2:
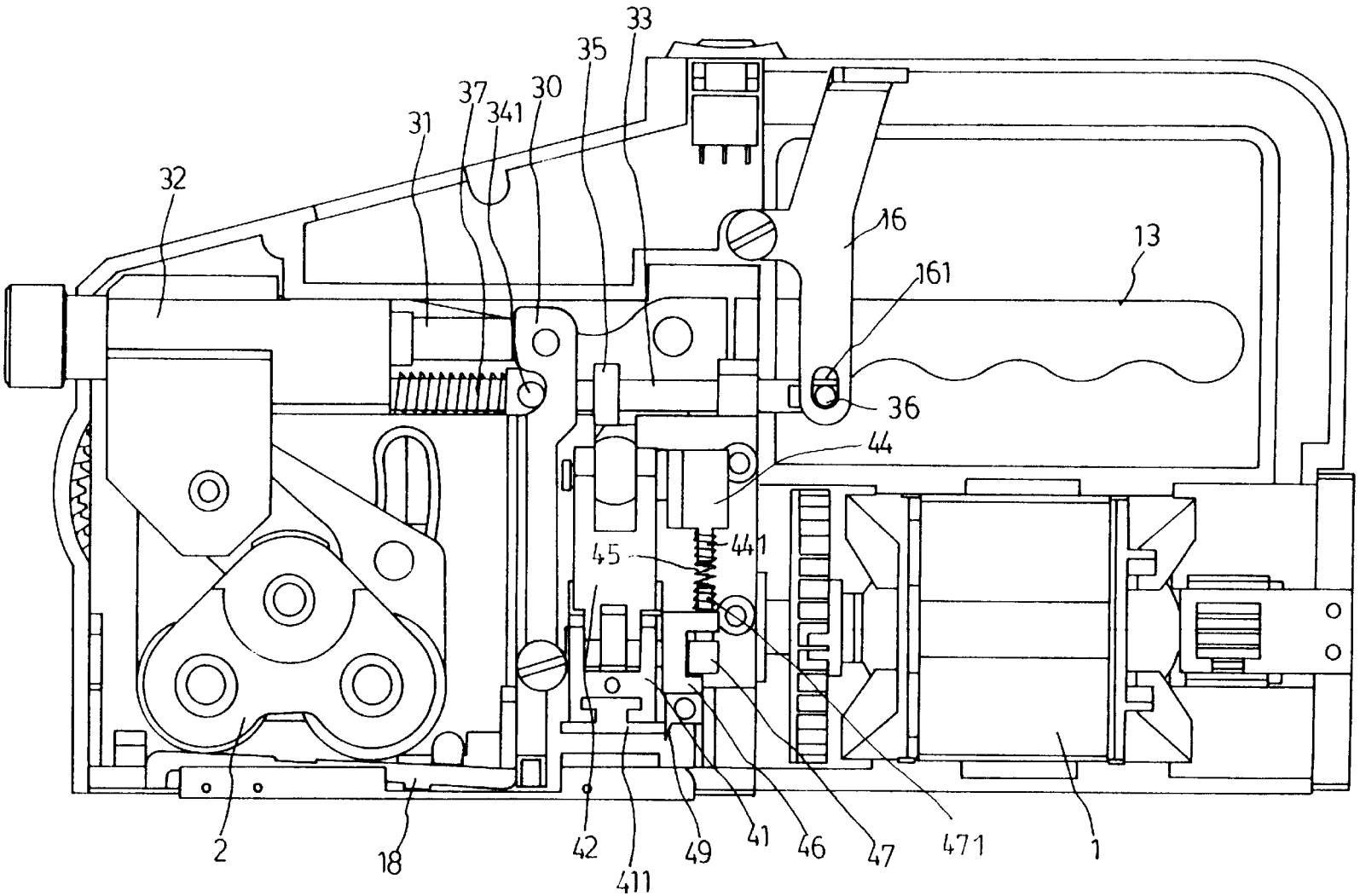
FIG. 2 is a plan front view of the apparatus of the invention.
Figure 3:
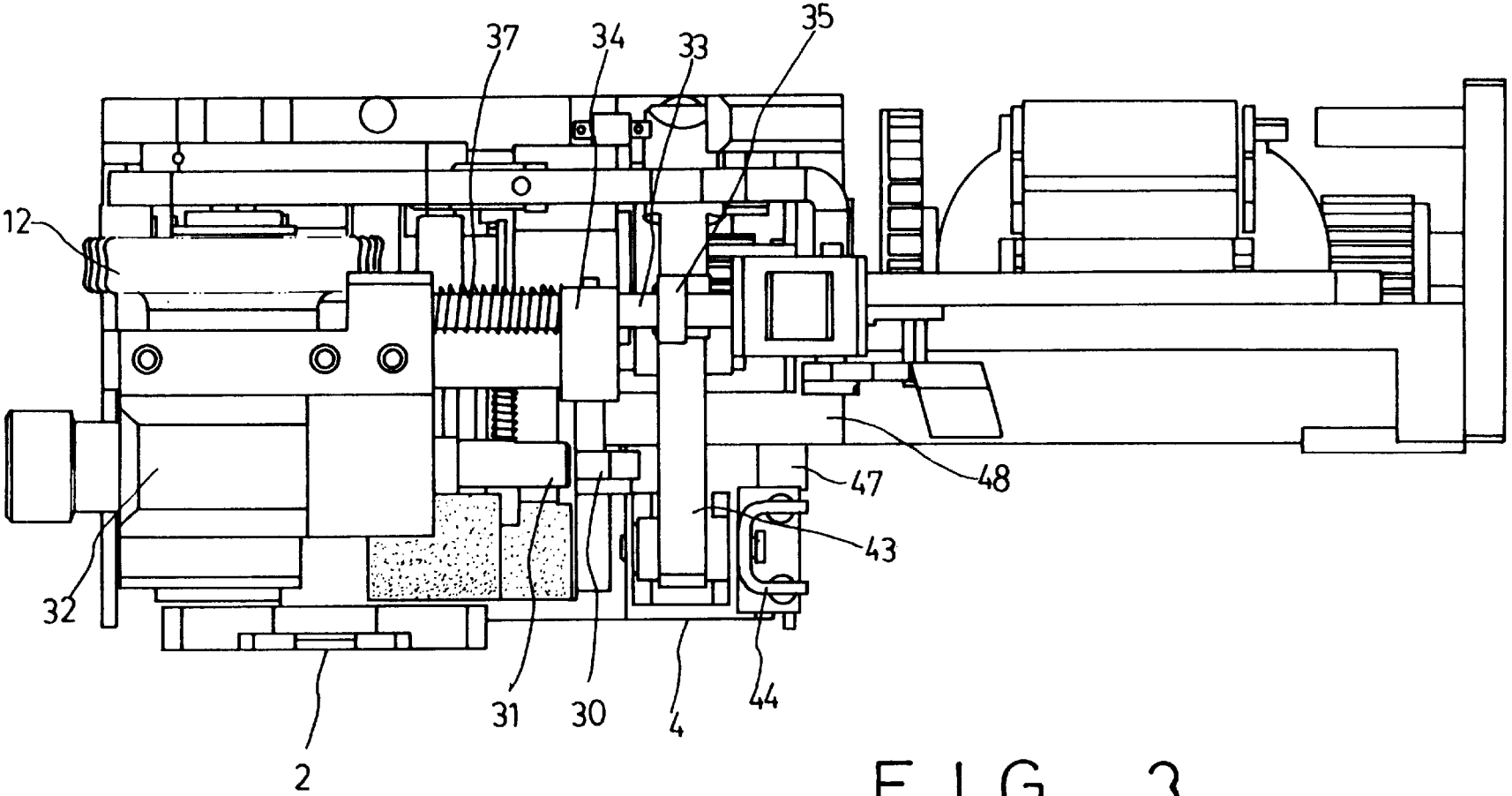
FIG. 3 is a plan top view of the apparatus of the invention.
Figure 4:
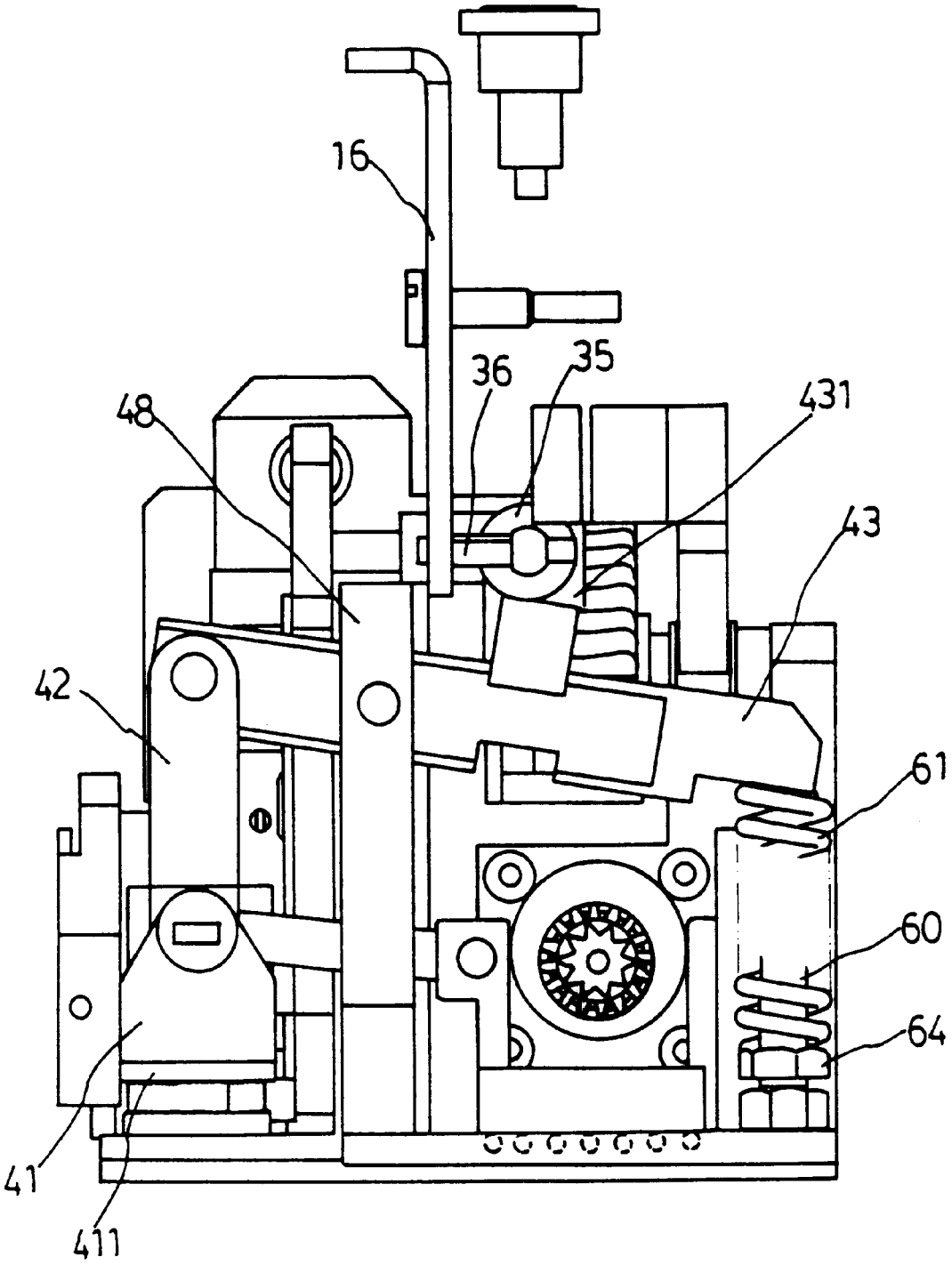
FIG. 4 is a plan right view of the apparatus of the invention.

For a better understanding, the apparatus of the invention is shown in the accompanying drawings with the housing detached to expose the internal structure of the apparatus. Referring to FIGS. 1 through 5, the invention comprises a motor (1) disposed on the lower portion of the binding apparatus as a driving unit. The motor drives a transmission axle (11) and a worm gear (12) to govern a tensioning unit (2) and a melting unit (4), in cooperation with bearings on the transmission axle. The main part of the apparatus is enclosed in a housing (14) with a handle (13) extending to the outside, a switch (15) disposed on the top, and a manual melting lever (16) pivotally attached to the housing. A base (17) extends beneath the tensioning unit (2) and the melting unit (4). Arranged under the tensioning unit (2) is a slant frictional board (18) on the inner and upper side of which a micro switch (19) is attached.

Figure 10:
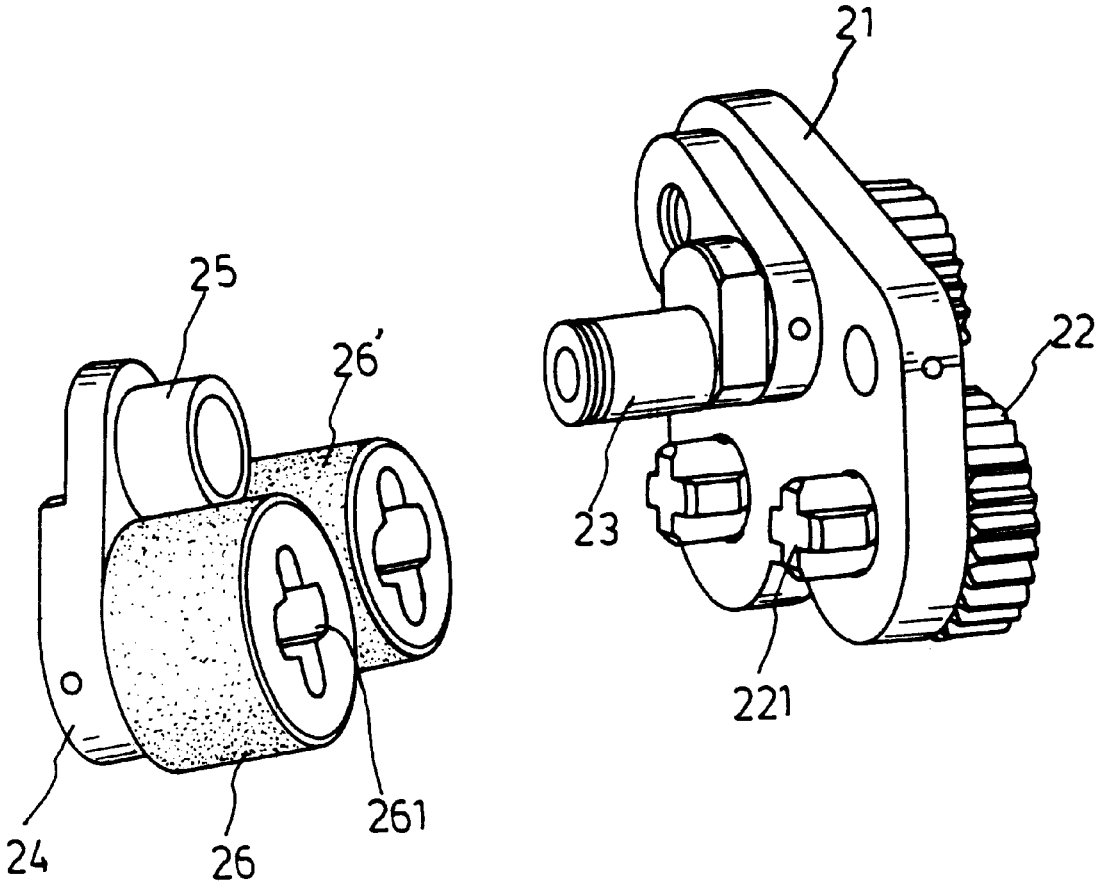
FIG. 10 is an exploded view partially showing the structure of the tensioning unit according to the invention.
Figure 11:
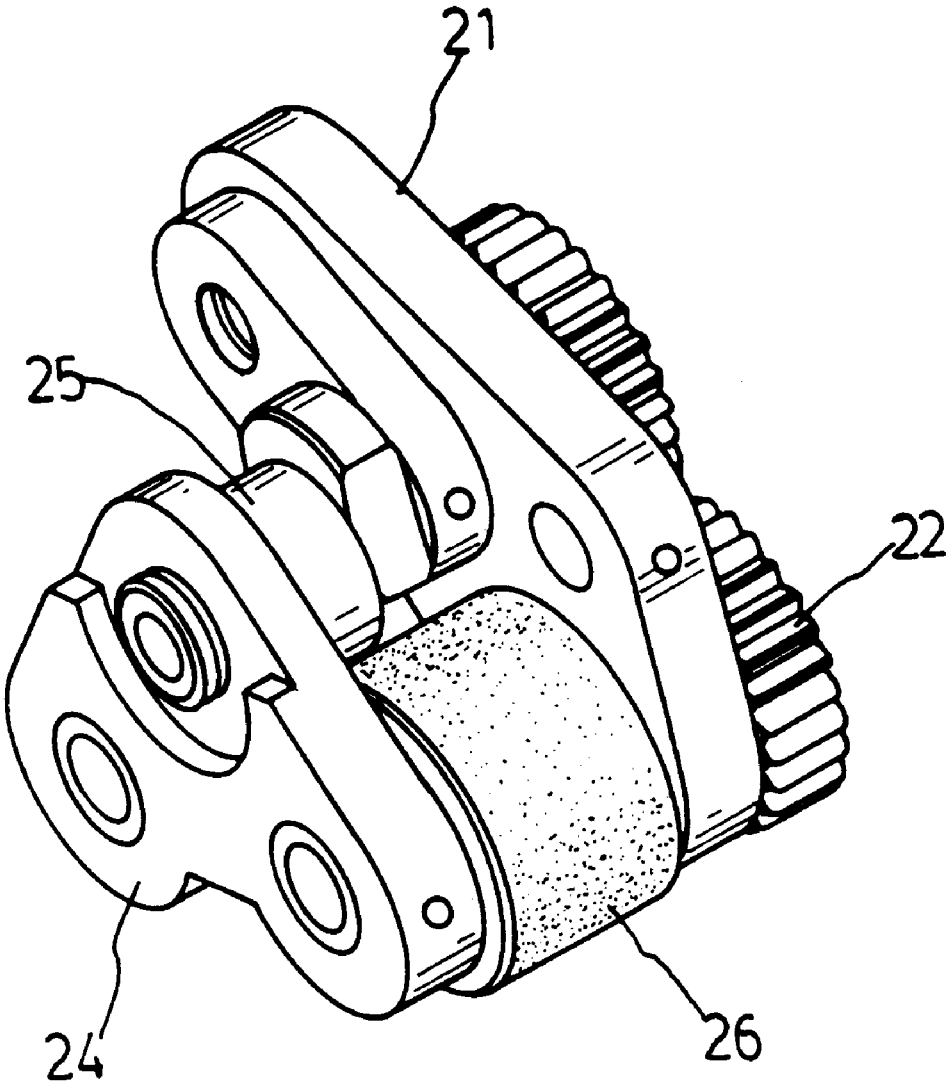
FIG. 11 is an assembly perspective view of the apparatus shown in FIG. 10.
Figure 13:
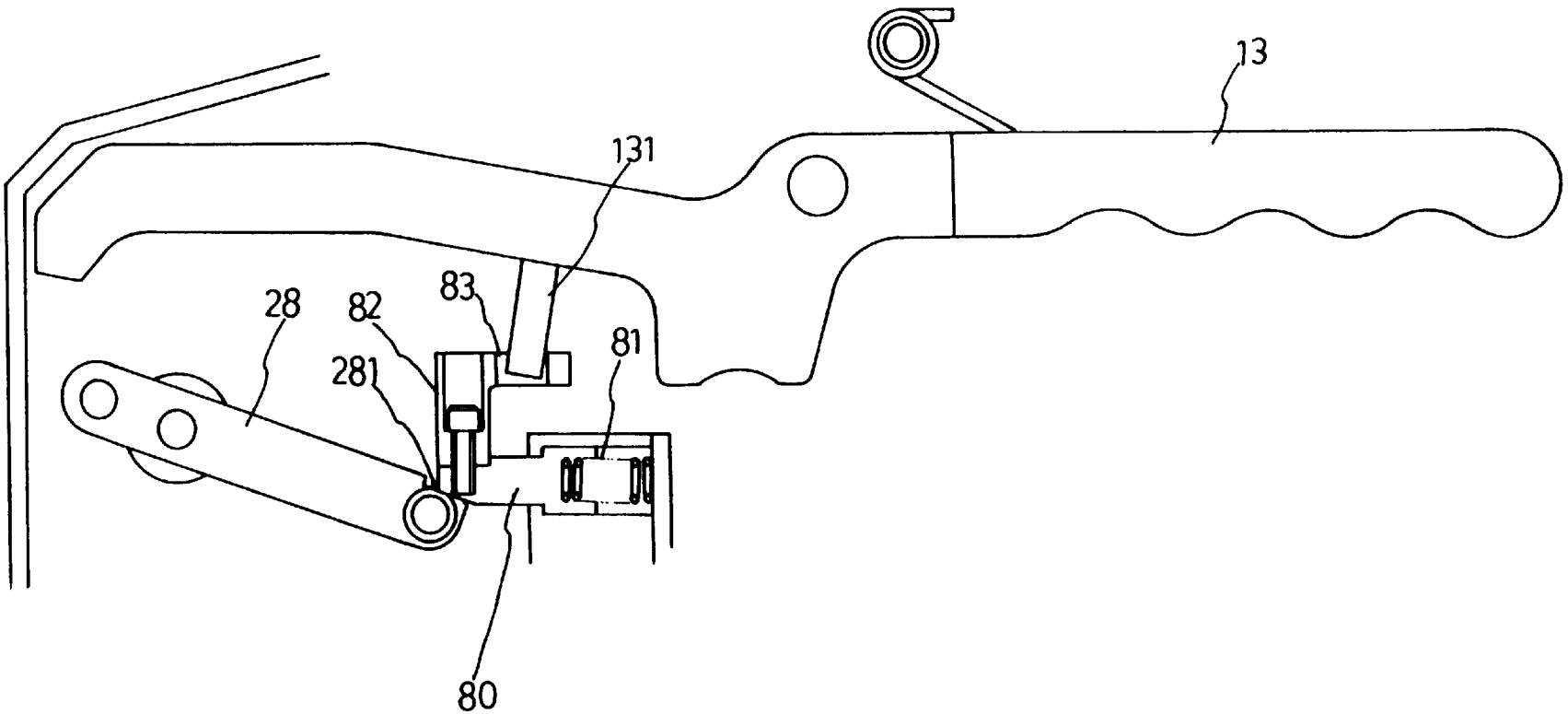
FIG. 13 is a partial cross sectional plan view of the apparatus of the invention.

The tensioning unit (2) includes a driving board (21) and a driven board (24). As shown in FIGS. 10 and 11, the driving board (21) is provided on one side with gears (22) engaged with the transmission mechanism. The driving board (21) is coupled with the driven board (24) by extending a shaft (23) of the former into a sleeve (25) of the latter. The cross-shaped shaft (221) of the gear (22) is inserted with clearance fit into the openings (261) formed on the large and the small friction wheel (26) and (26') of the driven board (24). The driving board (21) is connected at the upper and side corner with a link (27), which further is coupled at the other end with a driven plate (28). The driven plate (28) is pivotally attached at the middle to a base and abuts against the inner end of the handle (13) at the free end. When handle (13) is urged, the driven plate (28) is moved downwardly. The driven plate (28) is provided with a notch (281) disposed on the upper corner near the end thereof connected to the link (27), which notch is configured to be locked by a stop block (80). As shown in FIG. 13, the stop block (80) is connected at one end to the base of the apparatus and a spring (81) that biases the stop block (80) outwardly. The stop block (80) is equipped on the upper portion with a L-shaped seat (82) that has an elongated opening (83) formed on the top to receive a post (131) disposed on the lower portion of the handle (13). When the handle is lifted at the end, the post (131) urges the stop block (80) to escape from the notch (281) of the driven plate (28) and to move sideways into the base by the L-shaped seat (82). As a result, the driven plate (28) can be activated by a force exerted on the outer end thereof to urge the tensioning unit to rotate.

A swivel rod (30) is pivotally arranged between the tensioning unit (2) and the melting unit (4). The lower end of the swivel rod (30) is situated by the rear end of the frictional board (18) and the upper end is in touch with a push rod (31) inwardly extending from an adjustment block (32). The adjustment block (32) is connected at the outer end with a spring adjustment knob (321). Adjusting the spring force can change the contact pressure on the swivel rod (30) exerted by the push rod (31). The swivel rod (30) is further provided on one side with an extension rod (33). The extension rod (33) is coupled at the rear end with a strut (36) that extends into an opening (161) on the lower end of the manual melting lever (16). The extension rod (33) is furnished with a stationary block (34), and a ring (35), and a spring (37) disposed between the stationary block (34) and the adjustment block (32). A pin (341) extends from the stationary block (34) and stops on a recessed portion of the swivel rod (30).

The melting unit (4) includes a melting base (41). The melting base (41) is connected at the inner end to the transmission mechanism to be driven to move to-and-fro. The melting base (41) is further pivotally joined at the upper end with a connection block (42) so that when it is driven to move it acts like a suspender. The connection block (42) is pivotally linked at the upper end with a connection bar (43), which is further pivotally coupled with a stationary base (48). The connection bar (43) has a flat surface (431) on the top and a slant surface (432) under the ring (35) of the extension rod (33). The connection bar (43) is provided at the other end with an inverted U-shaped stop block (433), which extends to the top of a spring (61). The connection base (42) is furnished on one side with a U-shaped plate (44). The U-shaped plate (44) has a protrusion (441) on two sides, each protrusion (441) extending into the upper end of a spring (45). A guide block (46) is seated below the U-shaped plate (44) and receives a square column (47). The square column (47) is affixed at the inner end to the stationary base (48) of the apparatus and provided at the upper end with two cylindrical columns (471). Cylindrical columns pass through the guide block (46) and extend into the lower ends of two springs (45). A cutter (49) is fixedly arranged below the guide block (46).

Figure 5:
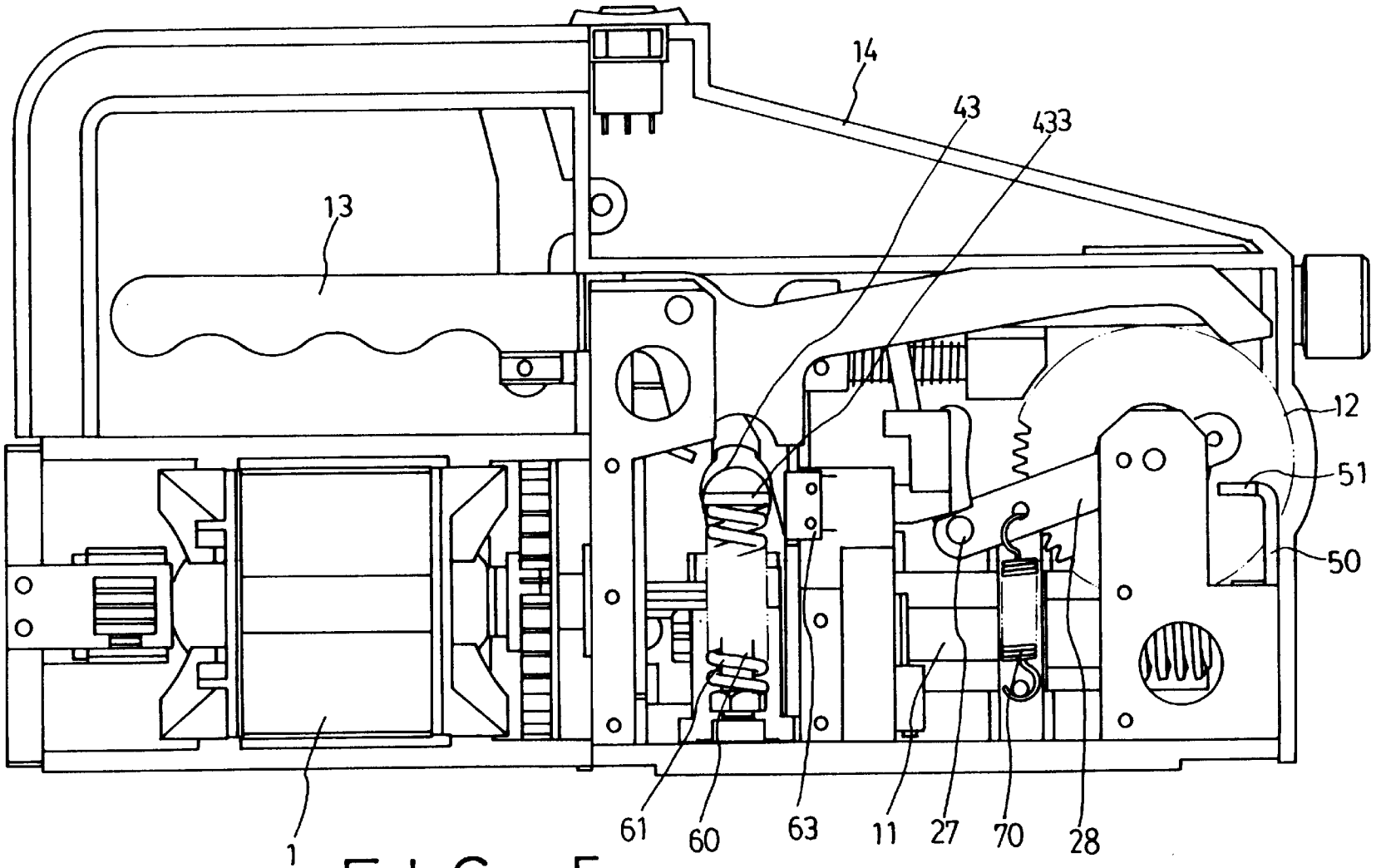
FIG. 5 is a plan rear view of the apparatus of the invention.

Referring to FIG. 5, a spring (61) mounting over an upright column (60) is disposed under the middle segment of the handle (13). The spring (61) abuts at the top end against the stop block (433) disposed near the end of the connection bar (43) and is adjacent to a tact switch (63) on one side. A spring (70) is hooked at the upper end to a round hole of the driven plate (28) and connected at the lower end to the base so that the free end of the driven plate is urged upwardly.

Figure 6:
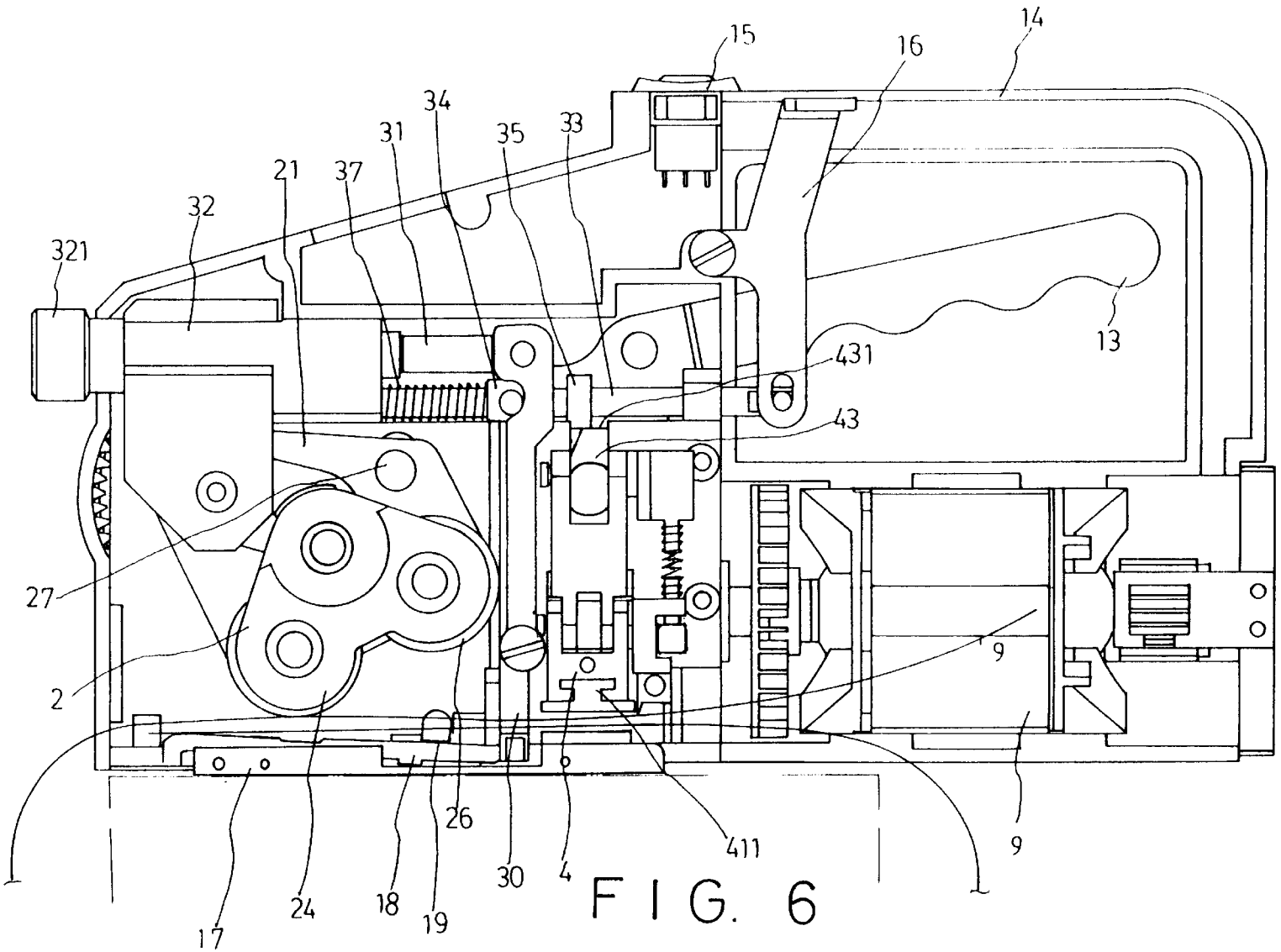
FIG. 6 is a plan view schematically showing the movement of the tensioning unit of FIG. 2 when it is lifted.
Figure 7:
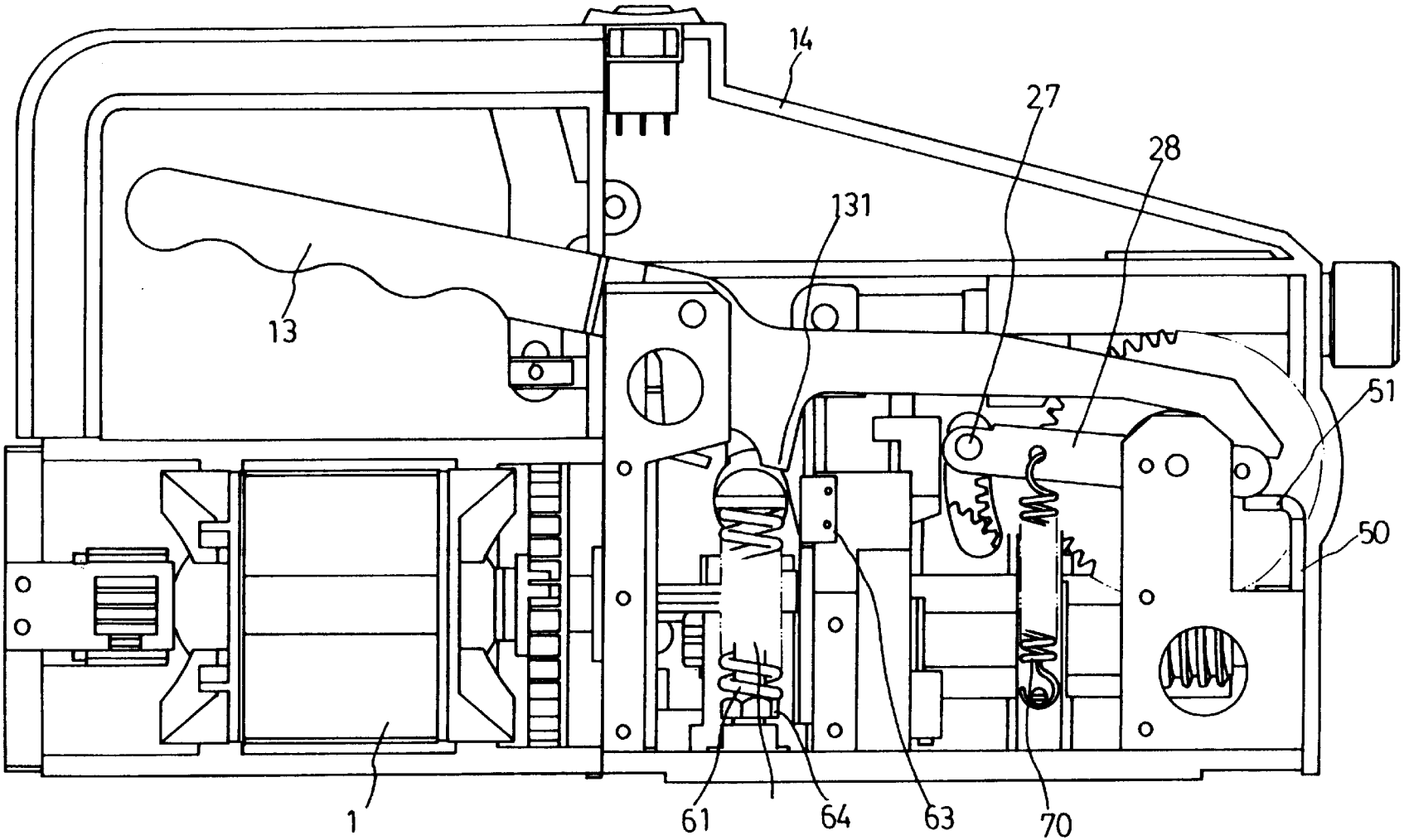
FIG. 7 is a plan view schematically showing the movement of the tensioning unit of FIG. 5 when it rises.
Figure 8:
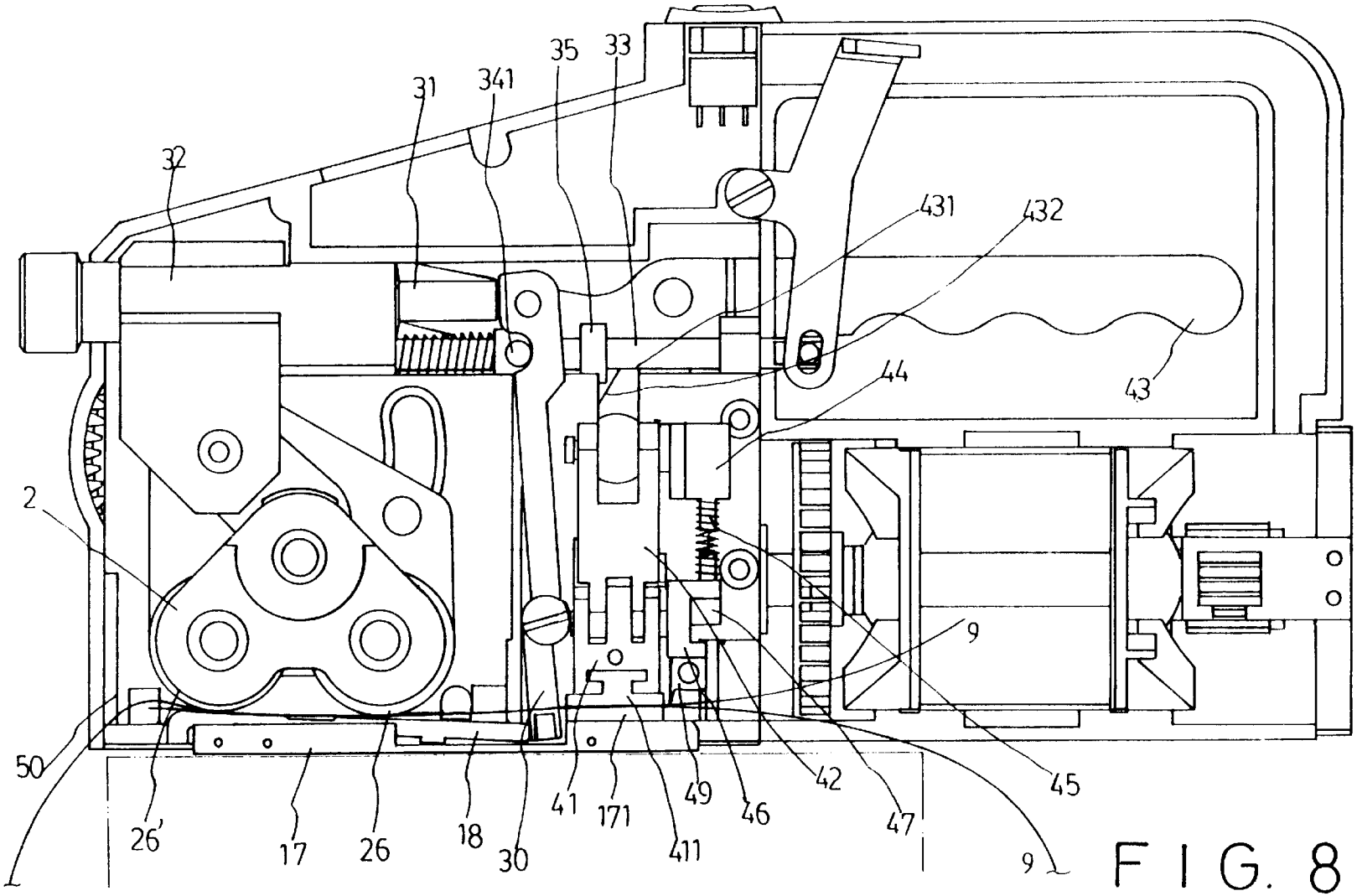
FIG. 8 is a plan view schematically illustrating the movement of the melting unit of FIG. 2 when it descends.

In operation, the handle (13) is lifted first. As shown in FIGS. 6 and 7, the handle (13) brings the stop block (80) by means of the post (131) to escape from the notch (281) of the driven plate (28). As a result, the front end of the handle (13) urges the free end of the driven plate (28) downwardly and the inner end of the driven plate (28) upwardly. By means of the link (27), the driving plate (21) swings a certain angle degree, together with the driven board (24) and the frictional wheels (26) and (26'). Then users can insert binding straps (9) into the space between the tensioning unit (2) and the frictional board (18) and extend it between the melting unit (4) and the base (17). When the binding straps is seated in position, the micro switch (19) is activated and then depressing the switch (15) can start the motor (1) to drive various units. This arrangement can ensure two frictional wheels (26) and (26') and the frictional board (18) will not malfunction or be even damaged due to incidental actuation.

With the handle (13) released, the driven plate (28) and the tensioning unit (2) under the effect of the spring (70) will restore to their initial states. The frictional wheels (26) and (26') will stably press the binding straps (9) against the slant frictional board (18). When the switch (15) is depressed, the rotation of two frictional wheels (26) and (26') will stretch the upper binding straps more and more, which makes the frictional board (18) decline gradually. The frictional board finally reaches a point where the frictional board (18) under the effect of a predetermined tension pushes the lower end of the swivel rod (30) to move. At this moment the upper end of the swivel rod (30) will urge the push rod (31) to move into the adjustment block (32). The frictional wheels also move the pin (341) to drive the stationary block (34) and the extension rod (33) to displace sideways. This will make the ring (35) separate apart from the top flat surface (431) of the connection bar (43). Thus one end of the connection bar (43) rises under the effect of the spring (61), with the other end depressing the melting unit (4). At the same moment, the tact switch (63) is activated to stop the tensioning unit (2) and start the melting unit (4). The upward resilient force of the spring (61) is adjustable through turning the nut (64) on the lower portion of the upright column (60).

To control the foregoing tension, turning the knob (321) may change the resilient force of the internal spring, which in turn change the action force of the push rod (31) and achieves the purpose of adjusting spring forces.

Figure 9:
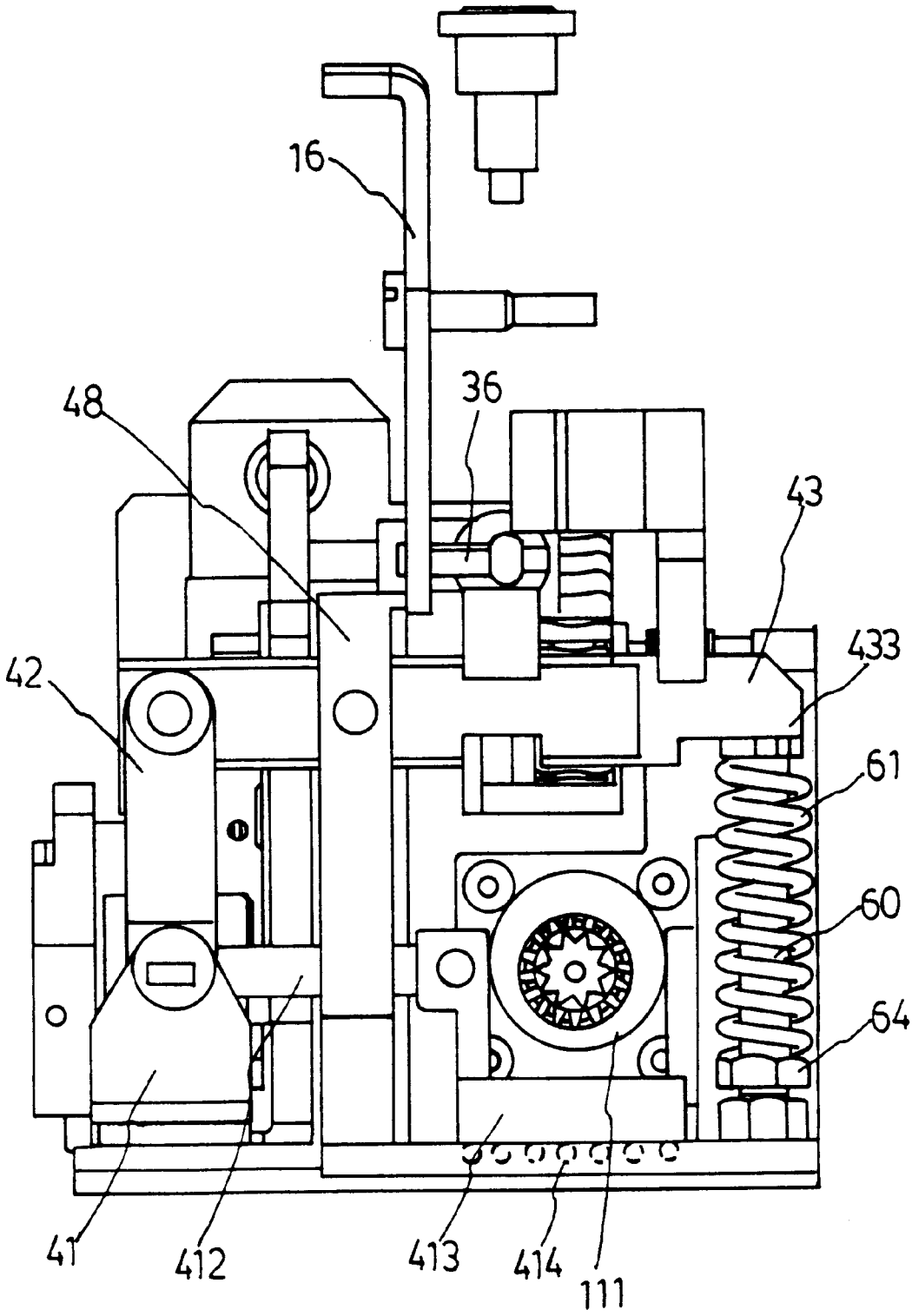
FIG. 9 is a right-side partial sectional view of the apparatus of FIG. 8.

After the melting unit (4) descends, the friction plate (411) under the melting unit (4) cooperates with another frictional plate (171) at a corresponding position on the base (17) to grip binding bands while a cutter (49) presses against the top surface of the upper strap. The melting unit (41) is pivotally connected to a driving plate (412) that is rotatably attached to a U-shaped block (413). As shown in FIG. 9, the U-shaped block (413) is provided on the lower portion with a plurality of rollers (414). The U-shaped space defined in the upper portion is outside the eccentric wheel (111) of the transmission axle (11) and thus it can be driven to move reciprocally, which makes the melting unit (41) quickly move to-and-fro. Consequently, the binding straps (9) are molten between two frictional plates. After melting is finished, the cutter (49) under the guide block (46) is urged by a resilient force to break the binding straps. Thus the invention can achieve the purpose of binding objects and cutting straps (9).

After the binding operation is completed, lifting the handle (13) can bring the binding straps and the binding apparatus to separate from each other. The frictional board (18) will not press against the swivel rod (30) forcefully. Motivating by the resilient forces in the adjustment block (32), the swivel rod (30) returns to its initial position. The extension rod (33) also moves sideways under the effect of the spring (37). Since the ring (35) on the extension rod (33) rests on the slant surface (432) of the connection bar (43) at this moment, it will urge the connection bar (43) to move downwardly gradually until the ring (35) reaches the top flat surface (431) of the connection bar (43). When one end of the connection bar (43) is depressed, the other end will ascend to bring the connection block (42) and the melting base (41) to move upwardly. As a result the melting unit (4) goes away from the base (17) and returns to its initial state.

As shown in FIG. 1, the manual melting switch (16) according to the invention has an opening (161) formed on the lower portion thereof, through which opening the strut (36) of the extension rod (33) extends. Therefore, during tensioning the binding straps, users can press down the lower end of the switch (16) to move the extension rod (33) sideways, which makes the ring (35) separate from the slant surface of the connection bar (43). After that, the foregoing tensioning operation is stopped and the melting operation starts. The manual control of the melting operation is achieved.

Figure 12:
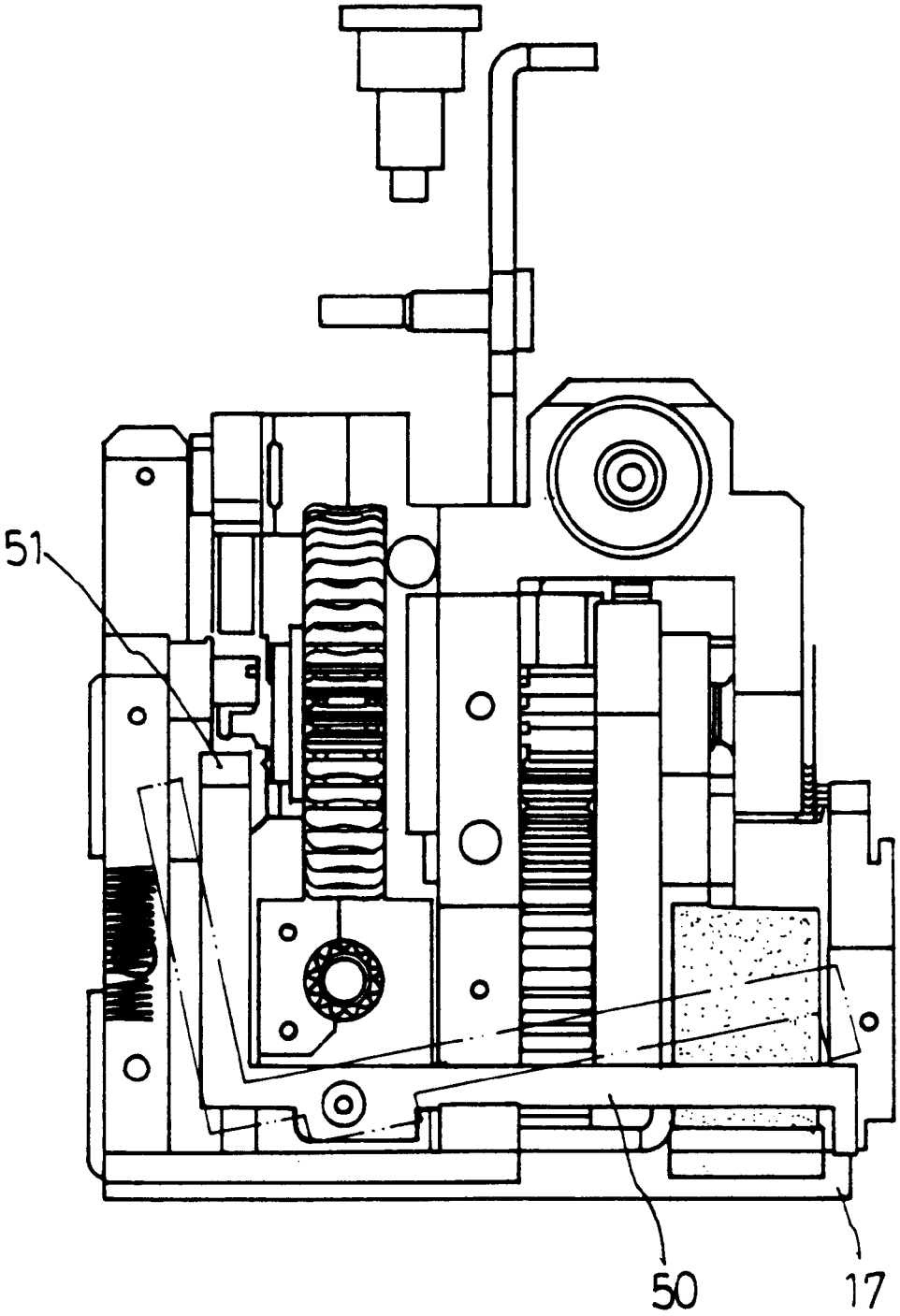
FIG. 12 is a schematic view illustrating the planar movement of the left-side structure of the apparatus according to the invention.

As shown in FIG. 12, the invention has two L-shaped blocks (50) respectively arranged on the front and the back of the main body. The L-shaped block (50) is pivotally connected at the middle position to the body, with the outer end thereof disposed outside the base (17) and the inner end extending upwardly. A tine (51) is formed at the inner end. When the handle (13) is lifted the driven plate (28) presses at its end against the tine (51) to arise the outer end of the L-shaped block (50). Such an arrangement allows placement or detachment of binding straps. When stretching or melting and sealing binding straps, the L-shaped blocks (50) confine the binding straps in its track, avoiding the bands slipping out of the preset route and achieving a guiding effect.

To sum up, the invention principally makes use of improved tensioning units and melting units to cooperate with a precisely controlled driving mechanism to complete the binding of objects. The binding apparatus according to the invention has the advantages of elaborate structural arrangement, having less weight, and convenience for hand carrying. It has superior performance than a conventional binding machine and meets the essence of a patent. We hereby file an application for a patent grant.

I claim:

1. A portable electrical binding apparatus including:

a motor disposed on the lower portion of the binding apparatus as a driving unit to drive a transmission axle and a worm gear to govern a tensioning unit and a melting unit, in cooperation with bearings on the transmission axle; and the main part of the apparatus being enclosed in a housing with a handle extending to the outside, a switch disposed on the top, and a manual melting lever pivotally attached to the housing; a base being extended beneath the tensioning unit and the melting unit; and arranged under the tensioning unit being a slant frictional board on the inner and upper side of which a micro switch being attached;

the said tensioning unit including a driving board and a driven board, wherein the driving board is provided on one side with gears engaged with the transmission mechanism and the driving board is coupled with the driven board by extending a shaft of the former into a sleeve of the latter; the cross-shaped shaft of the gear being inserted with clearance fit into the openings formed on the large and the small friction wheels of the driven board; the driving board being connected at the upper and side comer with a link, which further is coupled at the other end with a driven plate;

the driven plate being pivotally attached at the middle to a base and abuts against the inner end of the handle at the free end; and when handle is urged, the driven plate being moved downwardly; the driven plate being provided with a notch disposed on the upper corner near the end thereof connected to the link, which notch is configured to be locked by a stop block; the stop block being connected at one end to the base of the apparatus and a spring that biases the stop block outwardly; the stop block being equipped on the upper portion with a L-shaped seat that has an elongated opening formed on the top to receive a post disposed on the lower portion of the handle; when the handle is lifted at the end, the post urges the stop block to escape from the notch of the driven plate and to move sideways into the base by the L-shaped seat; and the driven plate can be activated by a force exerted on the outer end thereof to urge the tensioning unit to rotate;

a swivel rod being pivotally arranged between the tensioning unit and the melting unit, wherein the lower end of the swivel rod is situated by the rear end of the frictional board and the upper end is in touch with a push rod inwardly extending from an adjustment block; the adjustment block being connected at the outer end with a spring adjustment knob; adjusting the spring force can change the contact pressure on the swivel rod exerted by the push rod; the swivel rod being further provided on one side with an extension rod; the extension rod being coupled at the rear end with a strut that extends into an opening on the lower end of the manual melting lever; the extension rod being furnished with a stationary block, and a ring, and a spring disposed between the stationary block and the adjustment block; a pin being extended from the stationary block and stopped on a recessed portion of the swivel rod;

the said melting unit including a melting base connected at the inner end to the transmission mechanism to be driven to move to-and-fro, and being further pivotally joined at the upper end with a connection block so that when it is driven to move it acts like a suspender; the connection block being pivotally linked at the upper end with a connection bar, which is further pivotally coupled with a stationary base; the connection bar having a flat surface on the top and a slant surface under the ring of the extension rod, and being provided at the other end with an inverted U-shaped stop block, which extends to the top of a spring; the connection base being furnished on one side with a U-shaped plate; the U-shaped plate having a protrusion on two sides, each protrusion extending into the upper end of a spring; a guide block seated below the U-shaped plate and receiving a square column, which is affixed at the inner end to the stationary base of the apparatus and provided at the upper end with two cylindrical columns that pass through the guide block and extend into the lower ends of two springs; a cutter being fixedly arranged below the guide block; and a spring mounting over an upright column being disposed under the middle segment of the handle; the spring abuts at the top end against the stop block disposed near the end of the connection bar and is adjacent to a tact switch on one side; another spring being hooked at the upper end to a round hole of the driven plate and connected at the lower end to the base so that the free end of the driven plate is urged upwardly.

2. A portable electrical binding apparatus as claimed in claim 1, wherein the said tensioning unit including a driving board and a driven board, wherein the driving board is provided on one side with gears engaged with the transmission mechanism and the driving board is coupled with the driven board by extending a shaft of the former into a sleeve of the latter; the cross-shaped shaft of the gear being inserted with clearance fit into the openings formed on the large and the small friction wheels of the driven board; the driving board being connected at the upper and side corner with a link, which further is coupled at the other end with a driven plate; the driven plate being pivotally attached at the middle to a base and abuts against the inner end of the handle at the free end; and when handle is urged, the driven plate being moved downwardly; the driven plate being provided with a notch disposed on the upper corner near the end thereof connected to the link, which notch is configured to be locked by a stop block; the stop block being connected at one end to the base of the apparatus and a spring that biases the stop block outwardly; the stop block being equipped on the upper portion with a L-shaped seat that has an elongated opening formed on the top to receive a post disposed on the lower portion of the handle; when the handle is lifted at the end, the post urges the stop block to escape from the notch of the driven plate and to move sideways into the base by the L-shaped seat; and the driven plate can be activated by a force exerted on the outer end thereof to urge the tensioning unit to rotate.

3. A portable electrical binding apparatus as claimed in claim 1, wherein a swivel rod being pivotally arranged between the tensioning unit and the melting unit, wherein the lower end of the swivel rod is situated by the rear end of the frictional board and the upper end is in touch with a push rod inwardly extending from an adjustment block; the adjustment block being connected at the outer end with a spring adjustment knob; adjusting the spring force can change the contact pressure on the swivel rod exerted by the push rod; the swivel rod being further provided on one side with an extension rod; the extension rod being coupled at the rear end with a strut that extends into an opening on the lower end of the manual melting lever; the extension rod being furnished with a stationary block, and a ring, and a spring disposed between the stationary block and the adjustment block; a pin being extended from the stationary block and stopped on a recessed portion of the swivel rod.

4. A portable electrical binding apparatus as claimed in claim 1, wherein the said melting unit including a melting base connected at the inner end to the transmission mechanism to be driven to move to-and-fro, and being further pivotally joined at the upper end with a connection block so that when it is driven to move it acts like a suspender; the connection block being pivotally linked at the upper end with a connection bar, which is further pivotally coupled with a stationary base; the connection bar having a flat surface on the top and a slant surface under the ring of the extension rod, and being provided at the other end with an inverted U-shaped stop block, which extends to the top of a spring; the connection base being furnished on one side with a U-shaped plate; the U-shaped plate having a protrusion on two sides, each protrusion extending into the upper end of a spring; a guide block seated below the U-shaped plate and receiving a square column, which is affixed at the inner end to the stationary base of the apparatus and provided at the upper end with two cylindrical columns that pass through the guide block and extend into the lower ends of two springs; a cutter being fixedly arranged below the guide block.

5. A portable electrical binding apparatus as claimed in claim 1, wherein the handle is lifted first as in use; the handle bringing the stop block by means of the post to escape from the notch of the driven plate, and the front end of the handle urging the free end of the driven plate downwardly and the inner end of the driven plate upwardly; by means of the link, the driving plate swinging a certain angle degree, together with the driven board and the frictional wheels; for inserting binding straps into the space between the tensioning unit and the frictional board and extending it between the melting unit and the base; when the binding straps is seated in position, the micro switch being activated and then depressing the switch starting the motor to drive various units; the arrangement being able to ensure two frictional wheels and the frictional board will not malfunction or be even damaged due to incidental actuation;

with the handle released, the driven plate and the tensioning unit under the effect of the spring restored to their initial states; the frictional wheels pressed the binding straps against the slant frictional board; when the switch being depressed, the rotation of two frictional wheels stretching the upper binding straps more and more, which makes the frictional board decline gradually; the frictional board finally reaching a point where the frictional board under the effect of a predetermined tension pushing the lower end of the swivel rod to move, and the upper end of the swivel rod urging the push rod to move into the adjustment block; the frictional wheels also move the pin to drive the stationary block and the extension rod to displace sideways to make the ring being separated apart from the top flat surface of the connection bar; one end of the connection bar rising under the effect of the spring, with the other end depressing the melting unit; and the tact switch being activated to stop the tensioning unit and start the melting unit; the upward resilient force of the spring being adjustable through turning the nut on the lower portion of the upright column (60); and after the melting unit descended, the friction plate under the melting unit cooperating with another frictional plate at a corresponding position on the base to grip binding straps while a cutter presses against the top surface of the upper strap; the melting unit being pivotally connected to a driving plate that is rotatably attached to a U-shaped block;

the U-shaped block being provided on the lower portion with a plurality of rollers; and the U-shaped space defined in the upper portion being outside the eccentric wheel of the transmission axle and driven to move reciprocally, which makes the melting unit quickly move to-and-fro; the binding straps being molten between two frictional plates;

after melting finished, the cutter under the guide block being urged by a resilient force to break the binding straps.

6. A portable electrical binding apparatus as claimed in claim 1, wherein the binding operation being completed, lifting the handle to bring the binding straps and the binding apparatus to separate from each other; the frictional board will not press against the swivel rod forcefully, and motivating by the resilient forces in the adjustment block, the swivel rod returned to its initial position; the extension rod also moved sideways under the effect of the spring;

the ring on the extension rod resting on the slant surface of the connection bar to urge the connection bar to move downwardly gradually until the ring reaches the top flat surface of the connection bar; when one end of the connection bar depressed, the other end ascending to bring the connection block and the melting base to move upwardly; and the melting unit going away from the base and returning to its initial state.

7. A portable electrical binding apparatus as claimed in claim 1, wherein the manual melting switch having an opening formed on the lower portion thereof, through which opening the strut of the extension rod extended; during tensioning the binding straps to press down the lower end of the switch to move the extension rod sideways, which makes the ring separate from the slant surface of the connection bar; the foregoing tensioning operation being stopped and the melting operation starting, and the manual control of the melting operation being achieved.

8. A portable electrical binding apparatus as claimed in claim 1, wherein the apparatus having two L-shaped blocks respectively arranged on the front and the back of the main body; the L-shaped block being pivotally connected at the middle position to the body, with the outer end thereof disposed outside the base and the inner end extending upwardly; a tine formed at the inner end; and when the handle being lifted the driven plate pressing at its end against the tine to arise the outer end of the L-shaped block to allow placement or detachment of binding straps; when stretching or melting and sealing binding straps, the L-shaped blocks confining the binding straps in its track, avoiding the bands slipping out of the preset route and achieving a guiding effect.

* * * * *